US006004367A

United States Patent [19]

Stopyra et al.

[11] Patent Number: 6,004,367

[45] Date of Patent: Dec. 21, 1999

[54] FRONT ACCESS COVER FOR AIR PURIFIER

[75] Inventors: Stephen Stopyra, Syracuse; Theodore S. Bolton, Liverpool, both of N.Y.

[73] Assignee: Carrier Corporation, Farmington, Conn.

[21] Appl. No.: 09/017,654

[22] Filed: Feb. 2, 1998

[51] Int. Cl.[6] ..... B01D 39/14

[52] U.S. Cl. ..... 55/467; 55/471; 55/490; 55/495

[58] Field of Search ..... 55/495, 490, 467, 55/471; D23/364, 354; 454/207; 62/262

[56] References Cited

U.S. PATENT DOCUMENTS

| | | | |
|---|---|---|---|
| 4,607,500 | 8/1986 | Bolton et al. | 62/262 |
| 5,454,231 | 10/1995 | Bolton et al. | 62/262 |
| 5,893,939 | 4/1999 | Rakocy et al. | 55/471 |

FOREIGN PATENT DOCUMENTS

| | | | |
|---|---|---|---|
| 59-217429 | 12/1984 | Japan | 55/495 |
| 1-168315 | 7/1989 | Japan | 55/467 |
| 2-107309 | 4/1990 | Japan | 55/471 |

*Primary Examiner*—David A. Simmons
*Assistant Examiner*—Robert A. Hopkins
*Attorney, Agent, or Firm*—Wall Marjama Bilinski & Burr

[57] ABSTRACT

Apparatus for closing the front of an air purifying unit that includes a main support frame upon which is secured a rear cover and a top cover. A removable front cover is arranged to pass over the front section of the support frame and closes against the top and rear cover. A latching device acts between the support frame and the top cover to secure the cover to the frame. Biasing members are mounted upon the support frame for urging the walls of the front and rear covers outwardly and guiding the covers into edge to edge alignment.

7 Claims, 3 Drawing Sheets

FRONT ACCESS COVER FOR AIR PURIFIER

BACKGROUND OF THE INVENTION

This invention relates to a removable cover for an air handling system and, in particular, to an access cover for a portable air purification unit.

As the air we breathe becomes more contaminated, the need for better, higher efficiency air purification equipment becomes more pronounced, particularly in the more densely populated areas. Much of the air pollution in these populated regions is caused by automobile exhaust emissions and industrial plants that burn fossil fuel in order to satisfy their power demands. This type of pollution is difficult to cleanse from the air and cannot be effectively handled by conventional filters found in furnace and air conditioning systems. As a consequence, people who suffer from respiratory ailments are oftentimes forced to remain indoors when the air quality drops below a certain safe value. Ideally, while indoors, these people should breathe air that has been circulated through a high efficiency air purifying system. These systems are typically costly and not easily transported from place to place. The dependability and efficiency of presently available low cost portable units, however, generally is less than satisfactory.

More specifically, this invention relates to a removable cover for a housing containing an air purification system wherein a changeable or cleanable air filter is mounted inside the housing. Removing the cover provides ready access to the filter assembly so that it can be removed from the housing for maintenance. Generally this type of cover becomes loosened with usage and thus allows air to leak from the housing lowering the efficiency of the air purification system. A loose cover also tends to rattle when the system blower is in operation which can be very annoying to anyone situated near the unit. These problems become more pronounced in portable units because of the additional stress that is placed on the housing when the unit is lifted and carried about.

SUMMARY OF THE INVENTION

It is therefore an object of the present invention to improve air purification units and, in particular portable air purification limits.

A further object to the present invention is to improve removable access covers utilized in air purification units.

A still further object of the present invention is to provide a removable access cover for a portable air purifier housing that locks tightly in place at closure to prevent air from escaping from the housing.

Another object of the present invention is to prevent the access cover of an air purifier housing from rattling when the system blower is in operation.

These and other objects of the present invention are attained by apparatus for providing full access to a filter mounted in a portable air purifier unit that includes a front access cover having top, bottom and two opposed side walls. The access cover is arranged to pass over the front section of the main support frame. A vertically disposed latching bar is mounted on the outside of the support side walls that coacts with latching ears mounted on the inside of the cover side walls. The latching ears are adapted to snap over the latching bars at closure to secure the cover to the support. A stop is mounted behind the ears to prevent further forward movement of the cover over the frame once the latching ears have engaged the latching bars. Biasing ribs having contoured top surfaces are also mounted upon the outside of the support side walls that engage the cover side walls and urge them outwardly. The front edges of the cover walls each contain edge flanges that interlock with mating edge flanges on abutting covers of the housing at closure to provide a tight seam for preventing air from leaking past the seam.

BRIEF DESCRIPTION OF THE DRAWINGS

For a better understanding of these and other objects of the invention, reference will be made to the following detailed description of the invention which is to be read in association with the accompanying drawings, wherein.

DESCRIPTION OF THE INVENTION

Figure 1:
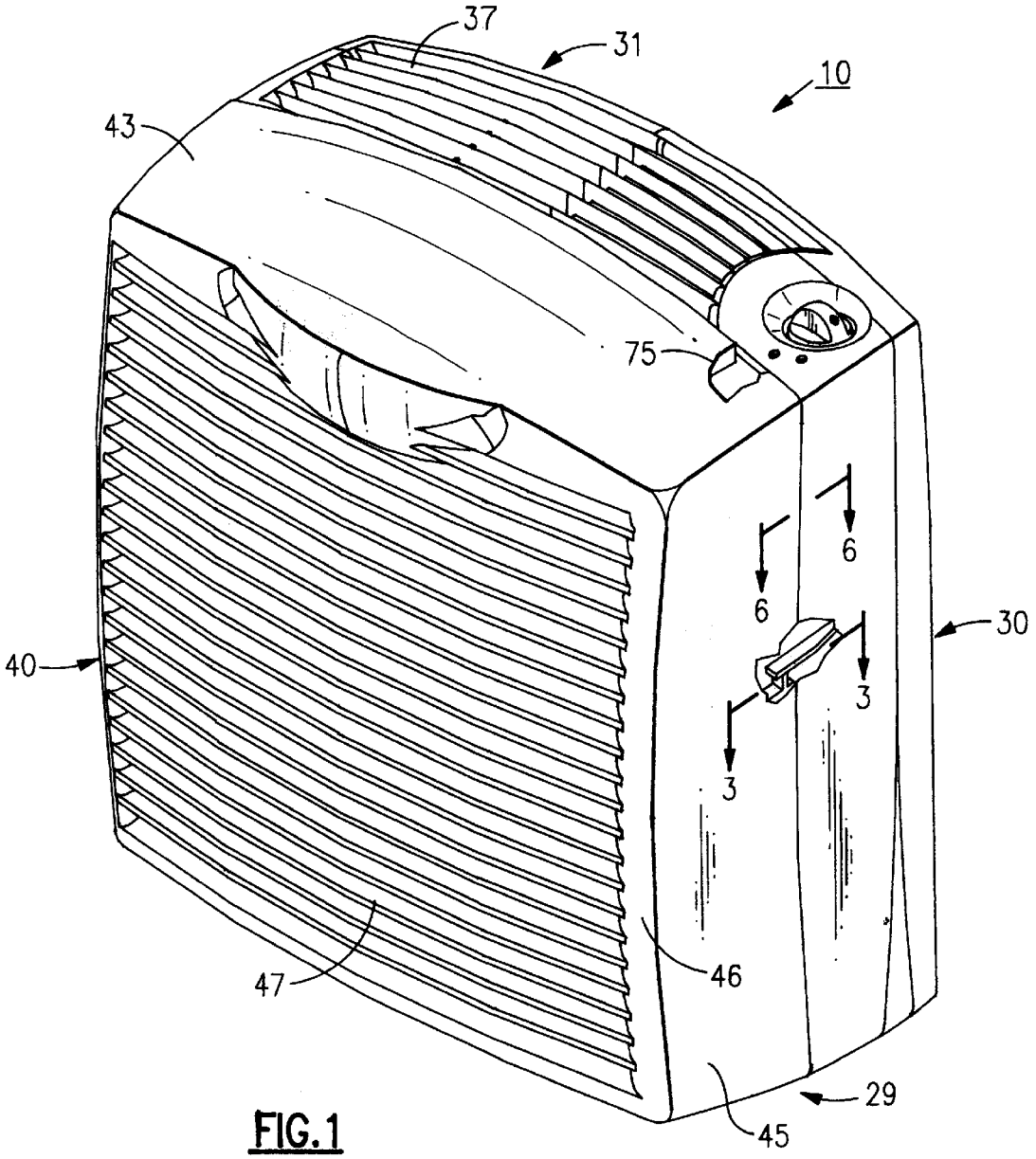
FIG. 1 is perspective view of an air purifier housing embodying the teachings of the invention.
Figure 2:
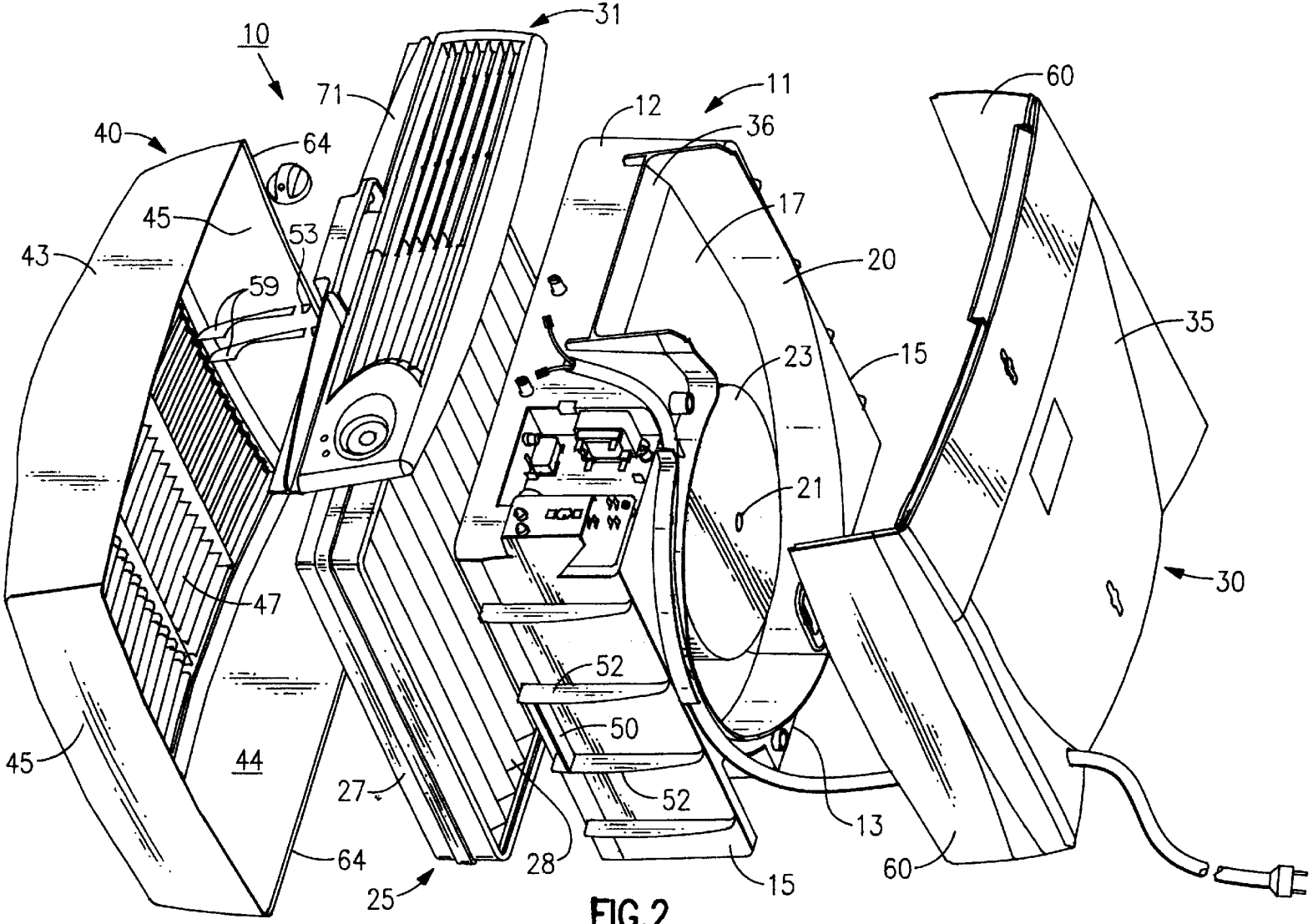
FIG. 2 is an exploded view in perspective showing the components of the air purification system and the housing.

Referring initially to FIGS. 1 and 2 there is shown a portable air purifier unit, generally referenced 10, embodying the teachings of the present invention. The unit contains a main support frame 11 having a top wall 12, a bottom wall 13 and opposed side walls 15. An interior wall 17 is molded integrally with the other wall, and contains a mounting bracket (not shown) on its front face upon which a blower motor (not shown) is secured. A scroll 20 is molded into the back face of the interior wall. The motor shaft 21 passes through an orifice in the interior wall into the scroll and a fan 23 is secured to the shaft within the scroll.

A filter assembly generally referenced 25 is removably secured to the front of the main support. The assembly includes a filter frame 27 that has a high efficiency particle arrestor (HEPA) filter 28 mounted therein.

The main support frame is totally enclosed by means of a three part housing 29 that includes a back cover 30 and a top cover 31, both of which are attached to the support frame by threaded fasteners and a front cover 40. The back cover contains a back panel 35 that forms the back wall of both the scroll and a discharge opening 36 in the top wall of the main support. The top cover contains an exhaust vent 37 through which air is discharged from the housing.

The housing further includes a removable front access cover 40 that embodies the teachings of the present invention. The access cover is arranged to pass over the front of the main support frame and the HEPA filter assembly mounted therein and abuts the top and rear covers of the housing to enclose the air purifier unit. The front access cover includes a top wall 43, a bottom wall 44, two opposed side walls 45 and a front panel 46 that is integral with the other walls. An air inlet vent 47 is contained in the front panel of the cover through which air enters the unit. As can be seen, the front access cover is large enough to permit removal and installation of the filter assembly when the cover is removed from the unit. The cover is molded of a resilient plastic.

Figure 3:
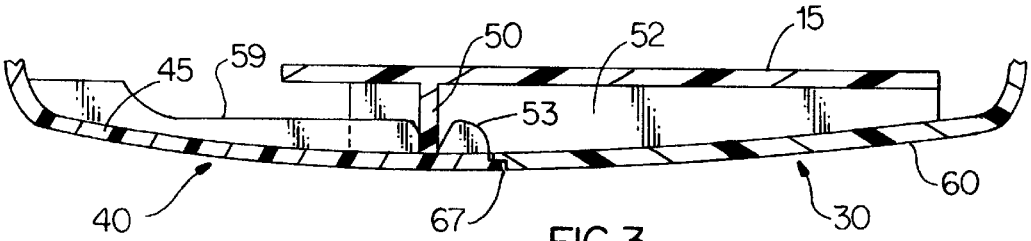
FIG. 3 is an enlarged partial side elevation in section showing the cover latching device in a closed condition.
Figure 4:
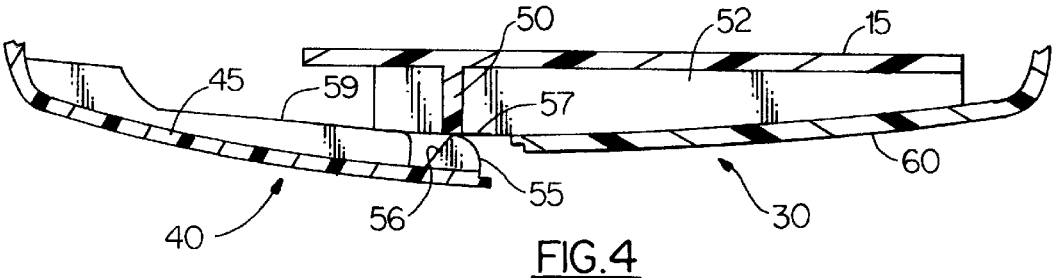
FIG. 4 is a side elevation similar to FIG. 3 showing the front access cover partially closed with the latching ears resting on the latching bar of the latching device.

With further reference to FIGS. 3–6, an elongated vertically disposed latching bar 50 is mounted upon the outside of each main support frame side wall between two horizontally disposed biasing members 52. A pair of latching ears 53 are mounted upon the inside of the front access cover side walls. The ears each have an inclined front face 55, and inclined back face 56 that are cojoined by an arcuate shaped top surface 57. As best illustrated in FIG. 4, the cover has sufficient resiliency to permit the latching ears to ride over the latching bars as the access cover is passed over the main support frame of the unit. As shown in FIGS. 2, 3 and 4, stop members 59 are mounted on the inside of the front cover side walls behind each ear to prevent further movement of the cover once the ears snap over the latching bar. At closure, the ears snap over the bars to removably secure the cover to the support frame as shown in FIG. 3.

Figure 5:
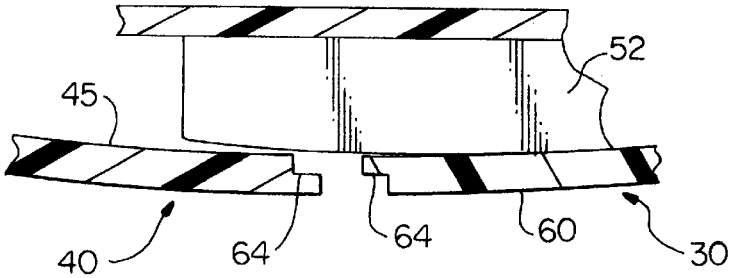
FIG. 5 is a partial side elevation in section showing the front edge of the front access cover being directed into interlocking engagement with the edge of the unit housing by a biasing rib.
Figure 6:
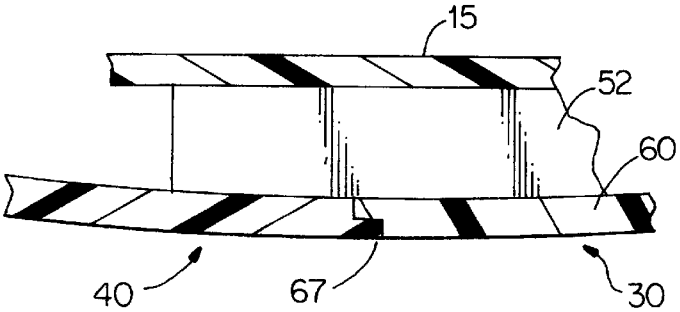
FIG. 6 is a partial side elevation similar to FIG. 5 showing the cover edge and the housing edge locked together to create a tight seam therebetween.

With further reference to FIGS. 5 and 6, a plurality of biasing members 52 are mounted upon the outside of the main support frame side walls. Each biasing member has a contoured outer surface that is inclined towards both the front and the back of the support frame. The biasing member contacts the side walls 60 of the rear cover which, like the front cover, is formed of a resilient plastic, and urges the walls outwardly to hold the cover in tension upon the support frame. Similarly, as illustrated in FIG. 5, the biasing members also are arranged to contact the side walls of the front cover to urge the walls outwardly as the cover moves toward closure.

A recess 64 is formed along the front edge of access cover walls which is arranged to interlock with companion recesses 64 formed in the top and rear covers at closure to create a tight seam 67 between the covers (see FIG. 6).

The top cover of the housing is fastened to the top wall of the support frame and contains a raised partition 71 that extends laterally across the top cover. At closure, the top wall of the front cover rests in contact against the top surface of the partition. Under the urging of the biasing members the top wall of the cover is drawn downwardly tightly against the partition to create a tight joint therebetween. A series of stop tabs 75 (FIG. 1) are mounted on the inside of the cover top wall which move into arresting contact against the raised partition to align the cover at closure and prevent further forward movement of the cover.

While this invention has been explained with reference to the structure disclosed herein, it is not confined to the details set forth and this invention is intended to cover any modifications and changes as may come within the scope of the following claims:

What is claimed is:

1. Apparatus for providing full access to an air purifier unit that includes:

an open front access cover that includes a top wall, a bottom wall, a pair of opposed side walls and a back panel that is integral with said walls whereby the walls of the cover are capable of passing over a portion of the outside of the side, top and bottom walls of a main support member of an air purifier unit to completely enclose the front of the support member and to partially enclose the outside of the main support member;

at least one latching ear mounted upon the inside of each cover side wall that is adapted to removably engage a latching bar on the main support member of the air purifier unit; each latching ear further includes front and back wall surfaces that are cojoined by an arcuate surface; and a stop means mounted behind each latching ear on the inside of each cover side wall to prevent further forward movement of the access cover when the latching ears are in engagement with the latching bars.

2. The access cover of claim 1 that further includes an air inlet formed in the front panel of the access cover.

3. The apparatus of claim 1 wherein said access cover is molded of a resilient plastic.

4. The apparatus of claim 1 wherein the leading edge of the front access cover walls each contains an inwardly facing recess extending along the length of the edge whereby the cover is capable of interlocking with other covers attached to the support to form a tight seam therebetween, wherein the front access cover walls can move outwardly without displacing portions of the other covers.

5. The apparatus of claim 1 wherein a plurality of ears are mounted on each of the access cover side walls.

6. Apparatus for providing full access to a filter assembly of an air purifier unit that includes:

a rectangular shaped main support frame formed of a resilient material having a top wall, a bottom wall and a pair of opposed side walls to form an open front face member;

a filter assembly that is slidably contained in the open front face of said frame;

a removable front access cover having a top wall, a bottom wall and opposed side walls and a front panel integrally joined to said cover walls so that said walls of said cover can pass over the walls of said frame to partially enclose the four walls of the frame within said cover;

a vertically disposed latching bar mounted upon the outer surface of each support frame side wall;

a horizontally disposed biasing member mounted on the outside of each frame side wall adjacent the top and the bottom of each latching bar, said each latching bar having a contoured upper surface for riding in sliding contact with the inner side walls of said front access cover and biasing said front access cover sidewalls outwardly to place the cover under tension;

at least one latching ear mounted upon the inside surface of each cover side wall for removably engaging one of said latching bars at closure to latch the cover to said support frame; and a first stop means mounted behind each latching ear on the inside of each cover side wall to prevent further forward movement of the front access cover when the latching ears are in engagement with the latching bars.

7. The apparatus of claim 6 including a second stop means disposed on the top wall of said front access cover, said second stop means for engaging a raised partition of a top cover of said air purifier unit.

* * * * *